US007708379B2

(12) United States Patent
Jeong

(10) Patent No.: US 7,708,379 B2
(45) **Date of Patent: *May 4, 2010**

(54) METHOD AND APPARATUS FOR DRIVING PRINTER HEAD AND IMAGE FORMATION

(75) Inventor: Jin-Wook Jeong, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 1062 days.

This patent is subject to a terminal disclaimer.

(21) Appl. No.: 11/262,810

(22) Filed: Nov. 1, 2005

(65) Prior Publication Data

US 2006/0139382 A1 Jun. 29, 2006

(30) Foreign Application Priority Data

Dec. 28, 2004 (KR) ..... 10-2004-0113700

(51) Int. Cl.
*B41J 2/15* (2006.01)

(52) U.S. Cl. ..... 347/41; 347/43; 347/12

(58) Field of Classification Search ..... 347/5, 347/9, 12, 19, 41–43
See application file for complete search history.

(56) References Cited

U.S. PATENT DOCUMENTS 6,209,987 B1 * 4/2001 Katayama ..... 347/43
6,688,727 B2 * 2/2004 Otsuki ..... 347/41
7,367,641 B2 * 5/2008 Jeong ..... 347/12
2002/0067393 A1 * 6/2002 Kanda et al. ..... 347/41

FOREIGN PATENT DOCUMENTS

| | | |
|---|---|---|
| JP | 10-034929 | 2/1998 |
| JP | 11-042769 | 2/1999 |
| JP | 2000-334962 | 12/2000 |
| JP | 2001-315332 | 11/2001 |
| JP | 2003-072097 | 3/2003 |
| KR | 1999-020086 | 3/1999 |
| KR | 1999-0038212 | 6/1999 |

* cited by examiner

*Primary Examiner*—Lam S Nguyen
(74) *Attorney, Agent, or Firm*—Roylance, Abrams, Berdo & Goodman, L.L.P.

(57) ABSTRACT

Provided are a method and apparatus for driving printing elements of a printer head in an image forming apparatus. The method includes calculating a number of driving groups among multiple driving groups in which at least a first predetermined number of printing elements are driven for each print line. The method calculates a number of print lines wherein the calculated number of driving groups are not less than a second predetermined number. The number of driving groups are increased if the calculated print lines is not less than a third predetermined number. Thus, it is possible to print with less power without a reduction in print quality or speed by controlling the driving of the printer head. In addition, the overall size of the image forming apparatus can be reduced by using low-power power supply.

13 Claims, 3 Drawing Sheets

METHOD AND APPARATUS FOR DRIVING PRINTER HEAD AND IMAGE FORMATION

This application claims the benefit of priority under 35 U.S.C. § 119(a) of Korean Patent Application No. 10-2004-0113700, filed on Dec. 28, 2004 in the Korean Intellectual Property Office, the entire disclosure of which is hereby incorporated by reference.

BACKGROUND OF THE INVENTION

1. Field of the Invention

The present invention relates to an image forming method and apparatus. More particularly, the present invention relates to a method and apparatus for driving printing elements of a printer head by analyzing the power necessary to print a page before printing, and driving the printing elements according to the analysis results.

2. Description of the Related Art

Generally, image forming equipment convert a document written by a user via an application program, or an image photographed with, for instance, a digital camera, into encoded data. The image forming equipment outputs the encoded data onto media, thereby making the document or image visible to the user.

Recently, image forming equipment having an array-head structure has been developed. In such image forming equipment, a printer head having the same length as the width of a medium onto which an image is to be printed is used to achieve high speed and high quality printing. To fascilitate high speed and high quality printing, the print head utilizes many printing elements to convey the image.

In the case of an inkjet printer, a printer head includes a plurality of nozzles. The nozzles convey ink onto a medium to print the image. For each nozzle to convey ink onto the medium, the nozzles must be supplied with power of a predetermined value.

Therefore, in the case of image forming equipment having an array-head structure, such as inkjet printers, power consumed to print an image greatly increases as the number of printing heads increase. An increase in print heads, in turn, requires a high-power power supply to accommodate the increased power consumption. Consequently, the size of the image forming equipment cannot be reduced due to the physical size of high-power power supplies.

SUMMARY OF THE INVENTION

The present invention provides a method and apparatus for driving a printer head having a plurality of printing elements to print an image with low power without reducing printing quality or speed. According to exemplary aspects of the present invention the printer head is driven using an analysis of printing power consumption before printing occurs.

According to an aspect of the present invention, there is provided a method for sequentially driving a plurality of printer head printing elements for printing an image onto a medium by dividing the printing elements into N driving groups. The method comprises calculating a number of driving groups among the N driving groups wherein at least a first predetermined number of printing elements are driven for each line of print. The method calculates a number of print lines wherein the calculated number of driving groups is at least that of a second predetermined number. The method then increases the number of N driving groups if the calculated print lines are at least that of a third predetermined number.

The printing elements may convey ink onto a medium to print an image.

In calculating the number of driving groups, the number of driving groups wherein at least the first predetermined number of printing elements are driven may be calculated so that a distance between adjacent printing elements, which are being simultaneously driven, is N times the distance between adjacent printing elements of the printer head.

The first predetermined number may be half the number of printing elements included in each of the driving groups, the second predetermined number may be 0.7 of the number of driving groups, and the third predetermined number may be set considering power supplied to the printer head.

According to another aspect of the present invention, there is provided an image forming apparatus for printing an image by sequentially driving a plurality of printer head printing elements of a printer head, the printing elements being divided into N driving groups. The image forming apparatus comprises a printer head having a plurality of printing elements and a data input unit for receiving image data of an image that is to be printed. The apparatus may further comprise a control unit for providing control signals to sequentially drive the printing elements by dividing the printing elements into the N driving groups according to the input image data, wherein an image can be printed by driving the printing elements according to the control signals.

The control unit may comprise a memory for storing image data and a line analyzer for reading image data from the memory and calculating a number of driving groups among the N driving groups wherein at least a first predetermined number of printing elements are driven for each line of print. The control unit may further comprise a page analyzer for calculating the number of print lines wherein the calculated number of driving groups are at least that of a second predetermined number. The control unit may also comprise a group determiner for increasing the number of N driving groups if the calculated number of print lines are at least that of a third predetermined number.

The printing elements may convey ink onto a medium to print an image.

The first predetermined number may be half the number of printing elements included in each of the driving groups, the second predetermined number may be 0.7 of the number of driving groups, and the third predetermined number may be set considering power supplied to the printer head.

The method can be embodied in a computer readable medium having stored thereon instructions for driving a printer head in accordance with aspects of the present invention.

BRIEF DESCRIPTION OF THE DRAWINGS

The above and other features and advantages of the present invention will become more readily apparent by the detailed description of exemplary embodiments thereof, with reference to the attached drawings, in which.

Throughout the drawings, like reference numbers should be understood to refer to like elements, features, and structures.

DETAILED DESCRIPTION OF THE INVENTION

The present invention will now be described more fully with reference to the accompanying drawings, in which exemplary embodiments of the invention are shown.

Figure 1:
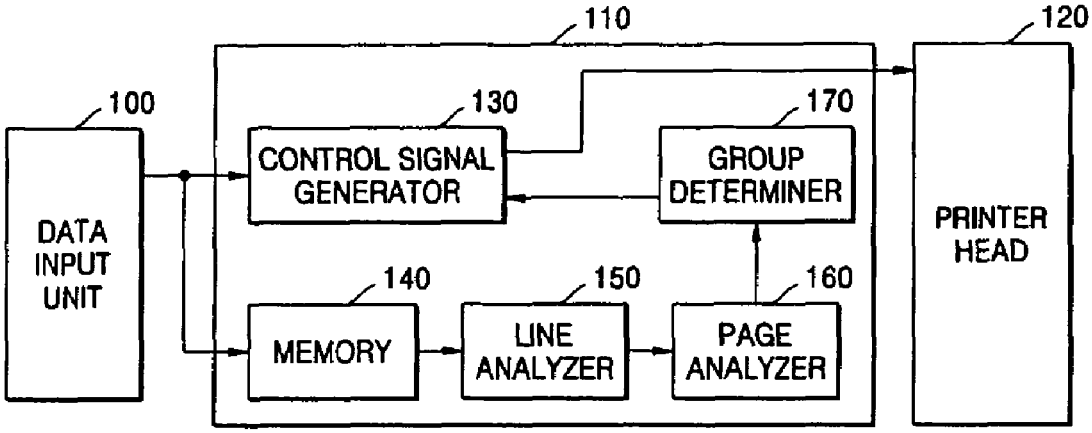
FIG. 1 illustrates a block diagram of an image forming apparatus according to an embodiment of the present invention.

FIG. 1 illustrates a block diagram of an image forming apparatus according to an embodiment of the present invention. The image forming apparatus includes a data input unit 100, a control unit 110, and a printer head 120. The control unit 110 includes a control signal generator 130, a memory 140, a line analyzer 150, a page analyzer 160, and a group determiner 170.

The data input unit 100 receives image data to be printed from a source such as a personal computer (PC), a digital camera, or a personal digital assistant (PDA).

The control unit 110 generates control signals to control operation of printer head 120 according to the input image data obtained from data input unit 100. Printer head 120 receives control signals from control unit 110 and drives a plurality of printing elements to print an image. Printer head 120 may be an inkjet printer having a plurality of nozzles which convey ink. In the case of a piezoelectric inkjet printer, each nozzle conveys ink using a piezoelectric element, or in the case of a thermal inkjet printer, a heater.

Figure 4:
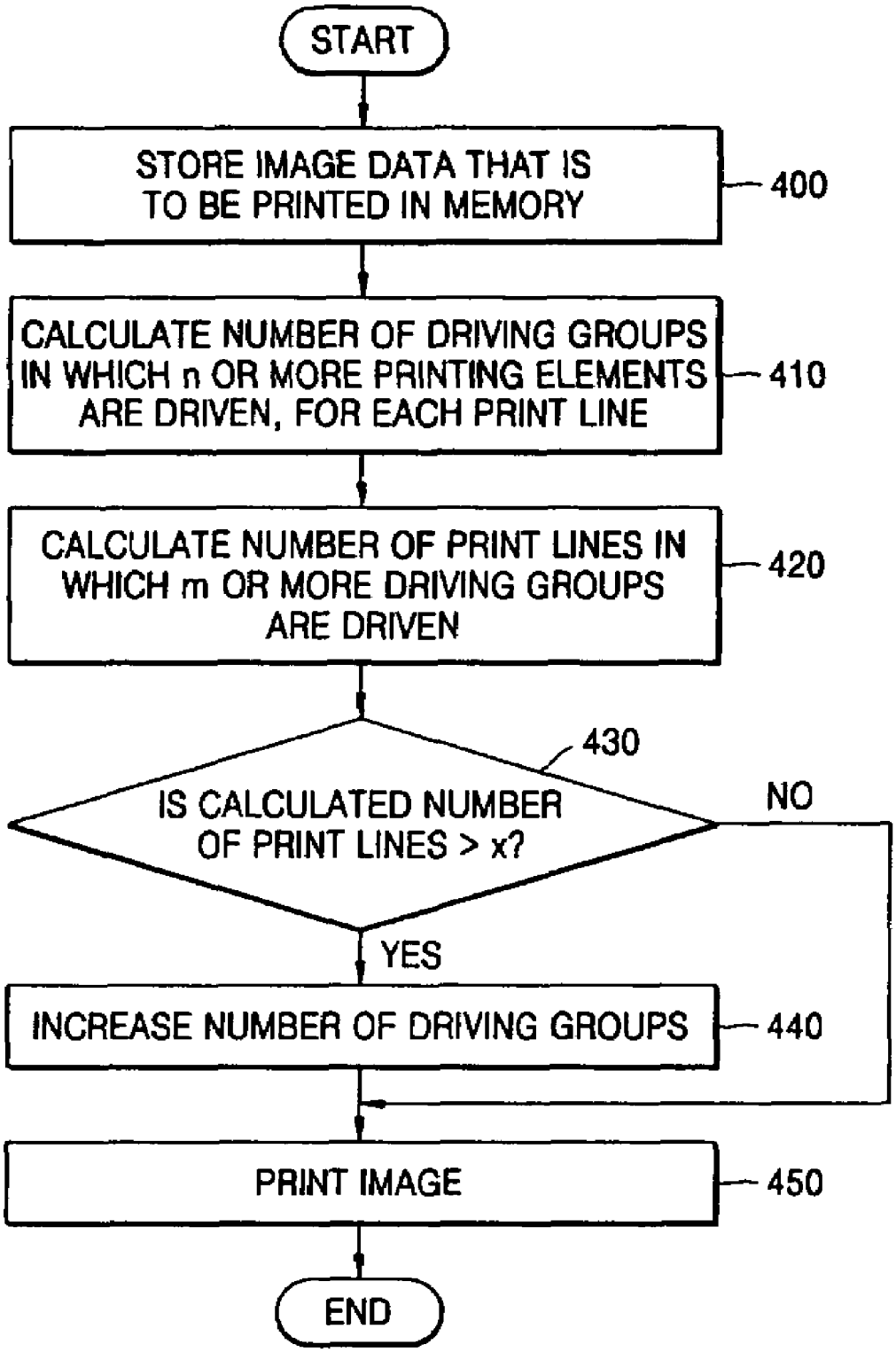
FIG. 4 shows a flow chart illustrating a method of driving a printer head according to an embodiment of the present invention.

The operations of control unit 110 will be described in more detail with reference to FIG. 4.

Figure 2:
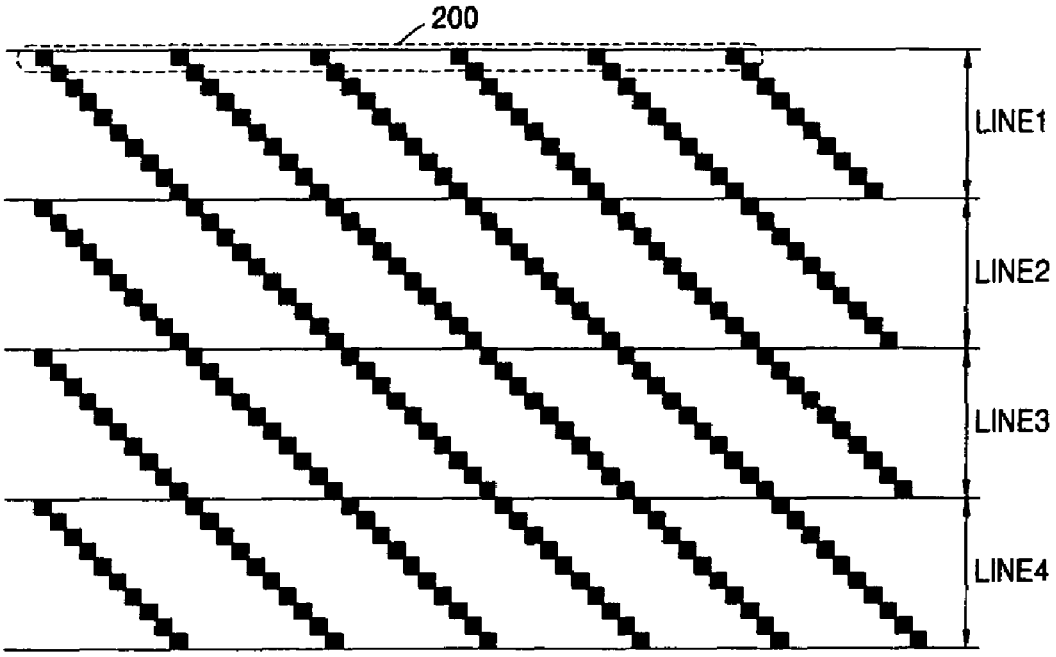
FIG. 2 depicts a view for explaining a method of sequentially driving a plurality of printing elements, which are divided into 10 driving groups, according to an embodiment of the present invention.

Image data input from data input unit 100 is stored in memory 140 in page units at step 400. Power consumption is high when simultaneously driving all printing elements in order to print only one print line of a page. Thus, the image forming apparatus can be configured to partially print one print line by dividing the printer head printing elements into a plurality of driving groups, then sequentially driving each group. FIG. 2 depicts a view to facilitate explanation of an embodiment of a method of sequentially driving a plurality of nozzles of an inkjet printer. In the example illustrated by FIG. 2, the nozzles are divided into 10 driving groups. Referring to FIG. 2, the exemplary printer has 60 nozzles, which are divided into 10 driving groups, each driving group having 6 nozzles. A first print line, Line 1, is printed by driving the nozzles to sequentially convey ink. The remaining second, third, and fourth print lines, Line 2, Line 3, and Line 4, are printed in the same way and result in a total of four print lines.

Line analyzer 150 reads the image data of a page from memory 140 and determines the number of driving groups to be simultaneously driven when the input image data is printed according to each print line. At step 410, the driving groups include at least a preset number n of printing elements. The preset number n may be half the total number of printing elements included in a single driving group.

The operation of step 410 will be described with reference to FIG. 2. Regarding the first print line, Line 1, line analyzer 150 determines how many nozzles among the 6 nozzles included in the first driving group 200 that need to be driven in order to print the image data. Also, line analyzer 150 determines how may nozzles need to be driven in the remaining second through tenth driving groups. Then, line analyzer 150 determines the number of surplus driving groups in which three or more printing elements are to be driven. The line analyzer 150 repeats the same operations listed above for the remaining second through fourth print lines, Line 2, Line 3, and Line 4, to determine the number of surplus driving groups in which three or more printing elements are to be driven for each of the second through fourth print lines, Line 2, Line 3, and Line 4.

Page analyzer 160 receives the number of surplus driving groups of each first through fourth print lines, Line 1, Line 2, Line 3, and Line 4, output from line analyzer 150. At step 420, page analyzer 160 calculates the number of surplus print lines among the first through fourth print lines, Line 1, Line 2, Line 3, and Line 4, in which the number of surplus driving groups is a preset number m or more. The preset number m may be 0.7 of the number of driving groups to sequentially print one line.

The operation of step 420 will be described with reference to FIG. 2. For example, it is assumed that the number of surplus driving groups of the first print line, Line 1, is 6; the number of surplus driving groups of the second print line, Line 2, is 8; the number of surplus driving groups of the third print line, Line 3, is 9; and the number of surplus driving groups of the fourth print line, Line 4, is 7. The preset number m is 7. Then, page analyzer 160 calculates the number of surplus print lines having not less than 7 surplus driving groups as 3.

The group determiner 170 receives the number of surplus print lines output from page analyzer 160 and, at step 430, determines whether the input number of surplus print lines is not less than a preset number x. If the input number of surplus print lines is not less than the preset number x, the number of driving groups is increased at step 440. The preset number x may be determined in consideration of the characteristics of power supply for printer head 120, such as continuity of current and efficiency. Alternatively, the preset number x can be arbitrarily set and the power supply designed to match the preset value.

If the number of driving groups is increased at step 430, the time taken to print one line will also increase. Thus, frequency of the printer head 120 should be adjusted accordingly.

Figure 3:
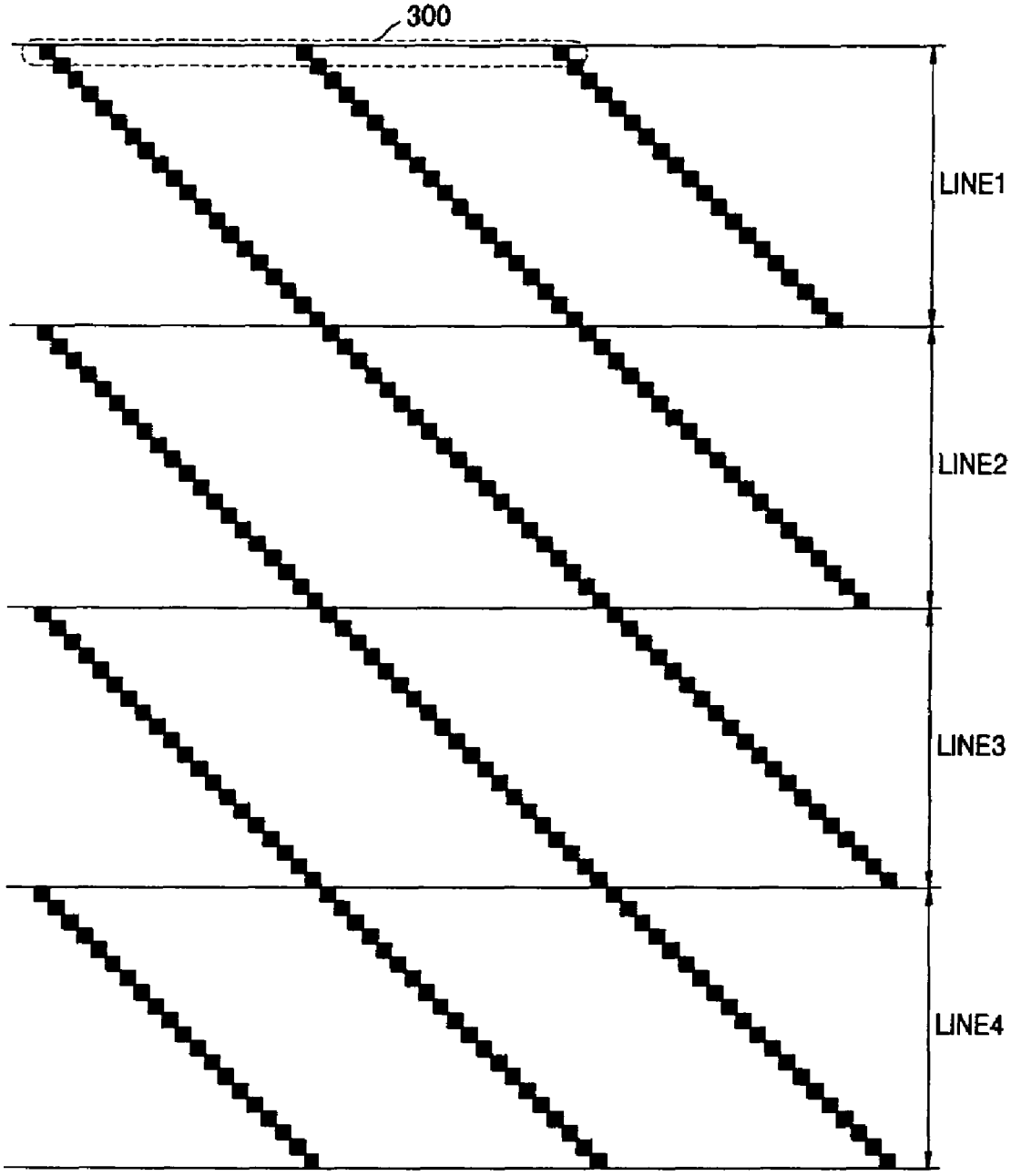
FIG. 3 depicts a view for explaining a method of sequentially driving a plurality of printing elements, which are divided into 20 driving groups, according to an embodiment of the present invention.

FIG. 3 depicts another view to facilitate explanation of an embodiment of a method of sequentially driving a plurality of nozzles. In the example illustrated by FIG. 3, the nozzles are divided into 20 driving groups. The driving groups are doubled in the embodiment illustrated by FIG. 3 as compared to the embodiment illustrated by FIG. 2. Therefore, using the method illustrated in FIG. 3, a total of four print lines, Line 1, Line 2, Line 3, and Line 4, can be printed by driving the nozzles to sequentially convey ink from a first group 300 of nozzles. A total of 60 nozzles are divided into 20 driving groups, each driving group including 3 nozzles. When the nozzles are driven as illustrated in FIG. 3, approximately 50% less power is consumed compared to the power consumed when driving the nozzles as illustrated by FIG. 2. Since the time required in printing a single print line doubles when the number of driving groups are doubled, as illustrated in FIG. 3, the frequency of printer head 120 utilization may be reduced by 50% compared to the embodiment illustrated in FIG. 2.

The control signal generator 130 provides control signals to control operations of printer head 120 depending on the number of driving groups input from group determiner 170. Printer head 120 drives the printing head according to control signals received and prints an image, as shown at step 450.

As described above, it is possible to print using less power without reducing printing quality or speed by controlling the driving of the printer head using analyzed printing consumption power before printing. In addition, the overall size of the image forming apparatus can be reduced because a low-power power supply may be used.

Aspects of the present invention can also be embodied in a computer readable medium having stored thereon instructions for carrying out the invention. A computer readable medium is any data storage device that can store data and can thereafter be read by a computer system. Examples of a computer readable medium include, but are not limited to, read-only memory (ROM), random-access memory (RAM), CD-ROMs, magnetic tapes, floppy disks, optical data storage devices, and carrier waves for data transmission. The computer readable medium can also be distributed over network coupled computer systems so that the computer readable instructions are stored and executed in a distributed fashion. Also, functional programs, codes, and code segments for accomplishing the present invention can be easily construed by programmers skilled in the art to which the present invention pertains.

While the present invention has been particularly shown and described with reference to exemplary embodiments thereof, it will be understood by those of ordinary skill in the art that various changes in form and details may be made therein without departing from the spirit and scope of the present invention as defined by the appended claims.

What is claimed is:

1. A method of sequentially driving a plurality of printing elements of a printer head, the method comprising:

dividing the printing elements into N driving groups, each of which is sequentially driven during printing;

calculating, among the N driving groups, a number of driving groups in each of which not less than a first predetermined number of printing elements are driven for each line to be printed;

calculating a number of print lines in each of which the calculated number of driving groups is not less than a second predetermined number; and increasing the number of N driving groups if the calculated number of print lines is at least a third predetermined number.

2. The method of claim 1, wherein the printing elements convey ink onto the medium to print the image.

3. The method of claim 1, in the calculating the number of the driving groups comprises calculating, the number of the driving groups is calculated so that a distance between adjacent printing elements that are simultaneously driven is N times a distance between adjacent printing elements of the printer head.

4. The method of claim 1, wherein the first predetermined number is half of the number of printing elements included in each of the driving groups.

5. The method of claim 1, wherein the second predetermined number is 0.7 of the number of driving groups.

6. The method of claim 1, wherein the third predetermined number is established in consideration of power supplied to the printer head.

7. The method of claim 1, wherein the print head operates at a frequency that is inversely proportional to the number of driving groups.

8. An image forming apparatus, comprising:

a printer head comprising printing elements;

a data input unit for receiving image data of an image; and a control unit for providing control signals to sequentially drive the printing elements by dividing the printing elements into N driving groups according to the input image data, each of said N driving groups being sequentially driven during printing, wherein the control unit comprises:

a memory for storing image data;

a line analyzer for reading the image data from the memory and calculating, among the N-driving groups, a number of driving groups in each of which at least a first predetermined number of printing elements are driven for each line of print;

a page analyzer for calculating a number of print lines in each of which the calculated number of driving groups is not less than a second predetermined number; and a group determiner for increasing the number of N driving groups if the calculated number of print lines is not less than a third predetermined number.

9. The image forming apparatus of claim 8, wherein the printing elements convey ink onto the medium to print the image.

10. The image forming apparatus of claim 8, wherein the first predetermined number is half of the number of printing elements included in each of the driving groups.

11. The image forming apparatus of claim 8, wherein the second predetermined number is 0.7 of the number of driving groups.

12. The image forming apparatus of claim 8, wherein the third predetermined number is established in consideration of power supplied to the printer head.

13. A computer readable medium having stored thereon instructions for sequentially driving a plurality of printing elements of a printer head, the instructions comprising:

a first set of instructions for dividing printing elements into N driving groups, each of which is sequentially driven during printing;

a second set of instructions for calculating, among the N driving groups, a number of driving groups in each of which at least a first predetermined number of printing elements are driven for each line to be printed;

a third set of instructions for calculating a number of print lines in each of which the calculated number of driving groups is at least a second predetermined number; and a fourth set of instructions for increasing the number of N driving groups if the calculated number of print lines is at least a third predetermined number.

* * * * *